United States Patent [19]

Megerle

[11] Patent Number: 5,060,860

[45] Date of Patent: Oct. 29, 1991

[54] PAINT CONDUCTIVITY MEASUREMENT SYSTEM

[75] Inventor: Clifford A. Megerle, Thousand Oaks, Calif.

[73] Assignee: Hughes Aircraft Company, Los Angeles, Calif.

[21] Appl. No.: 395,693

[22] Filed: Aug. 18, 1989

[51] Int. Cl.[5] ..... B05B 5/03

[52] U.S. Cl. ..... 239/67; 239/112; 239/463

[58] Field of Search ..... 239/690, 708, 66, 112, 239/75, 67, 463, 71; 118/691; 324/444, 439, 450, 446; 134/113

[56] References Cited

U.S. PATENT DOCUMENTS

| | | | |
|---|---|---|---|
| 3,714,555 | 1/1973 | Greer | 324/442 |
| 4,154,677 | 5/1979 | Mantell | 210/409 |
| 4,403,736 | 9/1983 | Scharfenberger | 239/112 |
| 4,586,523 | 5/1986 | Juenger | 134/113 |
| 4,751,466 | 6/1988 | Colvin et al. | 324/449 |
| 4,763,077 | 8/1988 | Miller | 324/439 |
| 4,769,607 | 9/1988 | Bauman et al. | 324/439 |
| 4,786,875 | 11/1988 | Carll | 324/444 |
| 4,791,946 | 12/1988 | Cavanaugh et al. | 239/112 |

FOREIGN PATENT DOCUMENTS

| | | |
|---|---|---|
| 2802182 | 7/1979 | Fed. Rep. of Germany . |
| 2223697 | 4/1990 | United Kingdom . |

OTHER PUBLICATIONS

Omega Engineering, Inc. article entitled, "About Conductivity", (Reprinted by permission from a Great Lakes Instruments, Inc. Bulletin).

*Primary Examiner*—Andres Kashnikow
*Assistant Examiner*—Christopher G. Trainor
*Attorney, Agent, or Firm*—M. E. Lachman; W. J. Streeter; W. K. Denson-Low

[57] ABSTRACT

A system and process for metering the delivery of liquids wherein the conductivity of the liquids is monitored at a metering device, such as a spray gun. Measurement of conductivity at the metering device provides continual measurement for fluctuations in conductivity and is useful for controlling liquid flow during sequential metering of different liquids.

10 Claims, 2 Drawing Sheets

PAINT CONDUCTIVITY MEASUREMENT SYSTEM

BACKGROUND OF THE INVENTION

1. Field of the Invention

The present invention relates generally to automated systems for metering and delivering liquids. More particularly, the present invention relates to automated spray painting systems used for applying electrostatic paints.

2. Description of Related Art

Many different industries utilize automated spray painting systems in order to provide a final protective coating to mass-produced articles. Such automated spray painting systems are widely used in the automobile industry due to the large number of cars produced and the requirement that a high-quality paint finish be provided to control corrosion and provide an attractive visual appearance.

Electrostatic paints are widely used in automated spray painting systems because of the improved coating coverage achieved with such paints and the reduction in waste. The object to be painted, such as an automobile, is electrostatically charged so that the electrostatically charged paint will be attracted to the automobile. It is important that the electrical charge present in the paint during spray application be within certain desired limits. Otherwise, incomplete coverage or excessive overspray will occur. Thus, the efficiency of an electrostatic paint spraying process depends on the accurate control of the electrical conductivity of the paint.

Typically, the conductivity of the paint is monitored by placing a hand-held probe into the paint reservoir which is designed to measure the direct current (DC) conductivity of the paint. Although such a monitoring system is suitable in some situations, it does have certain drawbacks in that DC measurements are subject to concentration polarization effects in which polarized species and thus the electric field become concentrated at the electrodes, lower the ion current to the electrode, and produce inaccurate measurements. In addition, such DC conductivity measurement systems do not provide accurate measurement of the paint conductivity at the most critical location, i.e., where the paint enters the spray gun for atomization. It is possible that the conductivity of the paint may change as it travels through the automated spray system so that the conductivity of the paint as it reaches the spray gun is substantially different from the conductivity measured in the paint reservoir. It would be desirable to have an automated electrostatic paint spray system in which the electrical conductivity of the paint is accurately monitored close to the point of delivery of the paint as a spray.

In addition most automated paint systems are designed to spray more than one color of paint. Typically, solvent is pumped through the system between paint changes. The amount of time and solvent which is necessary to flush paint from the system and begin spraying with the different paint is determined empirically. As a result, solvent and paint are wasted because excess solvent and/or paint is typically pumped through the system to ensure complete system cleaning and changeover of paint. It would be desirable to provide an automated paint system in which paint changeover can be continually monitored and accomplished with minimum waste of solvent and paint.

SUMMARY OF THE INVENTION

In accordance with the present invention, a system for metering the delivery of liquids is provided in which the conductivity of the liquid is measured close to or within the metering device or spray gun so that continuous, in-line monitoring of liquid conductivity is possible. The system may be used to monitor the delivery of a single liquid or paint to ensure that the conductivity of the liquid remains within desired specifications. As a feature of the invention, the system is used when liquids having measurably different conductivities are sequentially sprayed or metered. Measurement of liquid conductivity at or near the metering device allows accurate measurement and control of the liquids actually present at the metering device. As a result, solvent or paint waste is minimized during paint changeover in multiple paint systems.

The various systems which are possible in accordance with the present invention are based upon providing the conductivity cell within or close to the metering device or spray gun. The positioning of the conductivity measuring cell at this location provides numerous benefits not possible with systems where conductivity of the paint is measured only at the paint reservoir. Included among these advantages is the continuous monitoring of the paint to ensure that conductivity remains within a desired range. In addition, the flow of paint and solvent to the gun is accurately controlled in response to the conductivities measured at the spray gun. This reduces waste of paint and solvent due to unnecessary excess materials being pumped through the system. A further advantage of one embodiment of the present invention is that the conductivity is measured using an alternating current (AC) which precludes the concentration polarization effects of the prior art. The above-discussed and many other features and attendant advantages of the present invention will become better understood by reference to the following detailed description when taken in conjunction with the accompanying drawings.

DETAILED DESCRIPTION OF THE PREFERRED EMBODIMENTS

The present invention has wide application to systems which are used in metering a variety of liquids. The following description will be limited to a spray painting system designed to apply coatings of electrostatic paint to a wide variety of objects, such as automobiles. Although the following description will be limited to a spray system for dispensing paint, it will be understood by those skilled in the art that the invention is not limited to spray painting systems and has application to other liquid metering systems.

Figure 1:
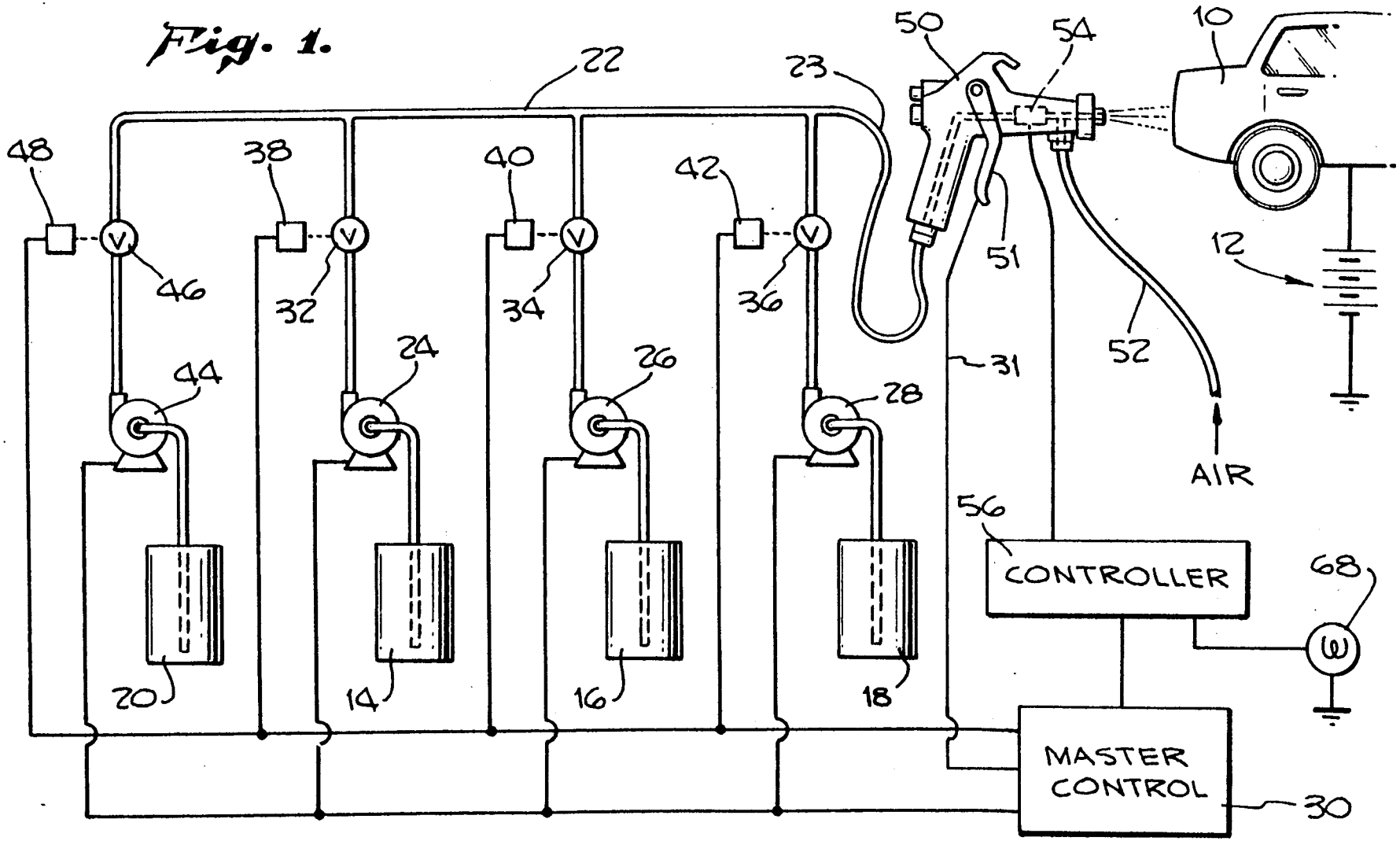
FIG. 1 is a schematic representation of a preferred exemplary system in accordance with the present invention for sequentially spray painting an automobile with paint.

A preferred exemplary electrostatic spray system is shown schematically in FIG. 1. The system is designed for applying electrostatic paints to an object such as automobile 10. As is well known, the automobile 10 is electrically biased as represented at 12 to provide an electrically charged surface to which the electrostatic paint is attracted. The electrostatic paints are contained in a plurality of reservoirs 14, 16, and 18. Electrostatic paints and the methods for making them are all well known and have been used for many years in the automobile industry. In this system, it is desirable that the electrostatic paints in the different reservoirs have measurably different conductivities. Typically, the liquids will have a resistance in the range of KilOhm-cm or MegOhm-cm. The solvent which is used to wash out the system during changeover between the various paints and reservoirs 14, 16 and 18 is contained in reservoir 20.

The electrostatic paints in reservoirs 14, 16 and 18 are pumped to manifold 22 by pumps 24, 26, and 28, respectively. The pumps 24, 26, and 28 are variable flow pumps which are controlled between full flow positions and off positions by master controller 30. Valves 32, 34, and 36 are also provided for controlling flow of the paints from reservoirs 14, 16, and 18, respectively. The valves 32, 34, and 36 are controlled by solenoids 38, 40, and 42, which in turn are controlled by master control 30. Pumping of solvent from reservoir 20 is also accomplished by a pump 44, valve 46, and solenoid 48 which are all controlled by master control 30. In place of pumps 24, 26, 28 and 44, other known liquid delivery methods, such as compressed air techniques, may be used to move the liquids through the system.

The paint and/or solvent is selectively passed through manifold 22 to liquid conduit 23 and then to the spray gun 50. If needed, air or other gas from a pressurized source is supplied to the spray gun through line 52 for atomization of the paint. The spray gun 50 includes a flow trigger 51 to control flow of liquid through the spray gun and is variably operable between an open flow position and a closed flow position. This flow trigger 51 is controlled by master control 30 as represented by line 31.

In accordance with one embodiment of the present invention, a conductivity cell 54 is provided in spray gun 50 for continuously monitoring the conductivity or resistivity of the paint or solvent flowing through the spray gun 50. The conductivity cell 54 is connected to a controller 56 which provides measurement and display of the conductivity of the paint flowing through conductivity cell 54. The measurement of conductivity from controller 56 is continually input into master control 30.

Figures 2, 3:
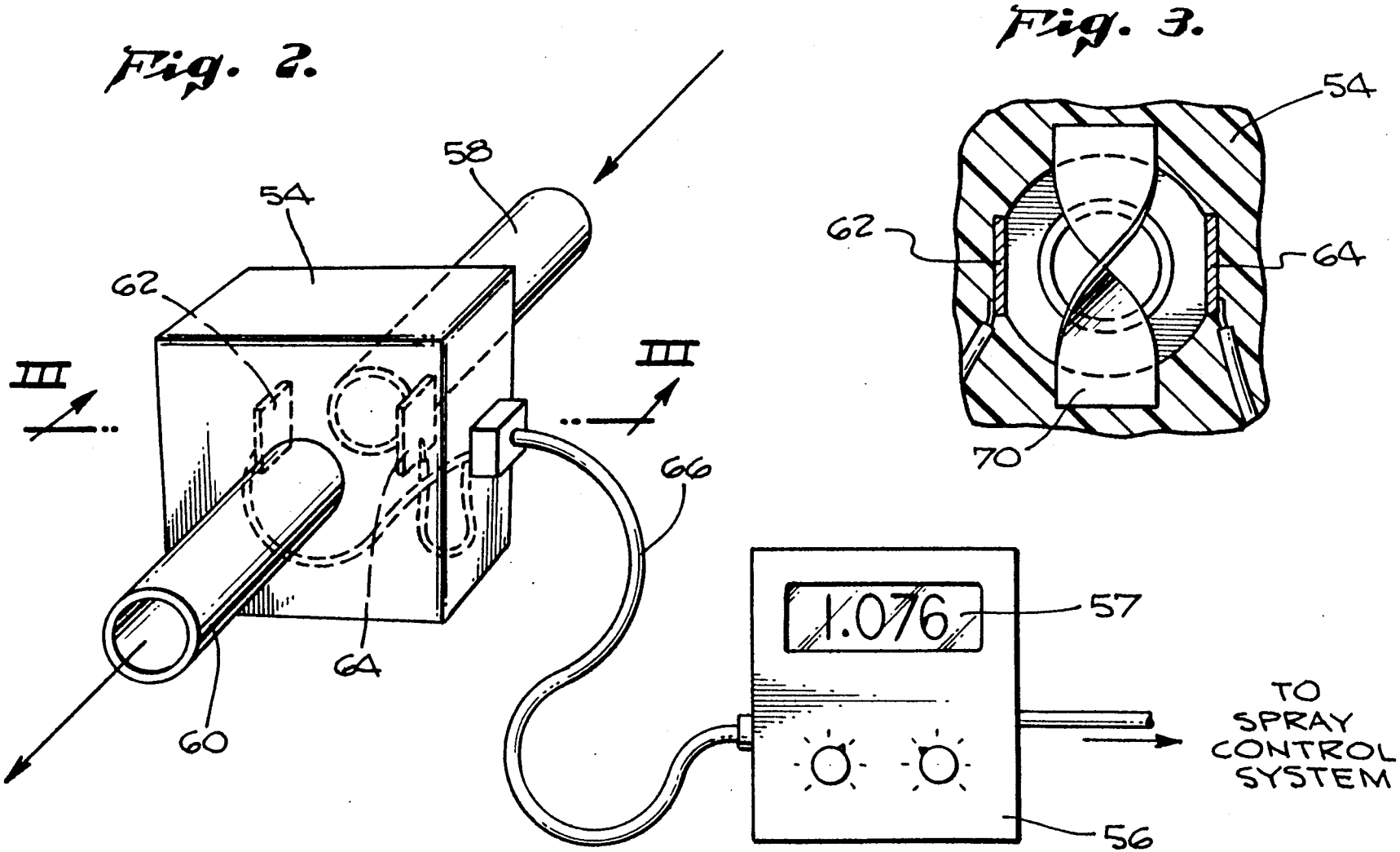
FIG. 2 is a detailed view of a preferred exemplary conductivity cell and measurement device in accordance with the present invention.
FIG. 3 is a sectional view of FIG. 2 depicting a preferred mixing baffle.

The conductivity cell 54 and controller 56 are shown in detail in FIGS. 2 and 3. The conductivity cell 54 has an inlet 58 and outlet 60. The interior of the cell 54 defines a chamber or flow zone through which the paint or solvent flows. The cell walls are preferably made from a non-conductive material, such as plastic or ceramic. The cell 54 includes two parallel electrodes 62 and 64. The electrodes are preferably as small as possible with sizes of 1 square centimeter being acceptable. It is desired to locate the electrodes 62 and 64 as close as possible together to minimize the size of conductivity cell 54. The electrodes are preferably spaced between about 1 cm to 3 cm apart. The electrodes 62 and 64 are connected by way of wire 66 to controller 56.

Controller 56 contains all of the electronics necessary to make alternating current (AC) conductivity measurements. As previously noted, it is preferred that AC conductivity measurements be made instead of direct current (DC) measurements in order to circumvent the concentration polarization effects that may adversely influence a DC measurement. Since the current is alternated at each electrode, polarization effects do not occur. Preferably a small AC voltage of between about 1-10 volts is imposed across the electrodes. An alternating current having a potential of 5 volts is preferred. The frequency of the AC current can be varied over a wide range, with frequencies in the neighborhood of 1,000 Hz being suitable. The current flow between electrodes 62 and 64 is monitored and the conductivity is calculated using the formula $$C = LI/(EA)$$

where C is the conductivity of the paint expressed in reciprocal Ohm-cm, L is the distance between the electrodes in centimeters, A is the area of the electrode in square centimeters, I is the measured AC current in amperes, and E is the applied AC voltage in volts.

The controller 56 supplies the voltage, measures the current between electrodes 62 and 64 and calculates the paint conductivity. Preferably, the controller 56 also contains information defining the acceptable range of conductivities for the paint and an appropriate algorithm for determining when the paint conductivity is out of specification. The controller 56 also contains a read-out such as a liquid crystal display 57. The measurement of conductivity is made periodically (approximately every 50-100 microseconds). If a number of successive measurements, or a moving average of successive measurements, convoluted with proportional, integral and/or differential control equations, passes outside of the control band, an alarm condition is signalled. An enunciator light 68 (see FIG. 1) is provided which is lighted when the controller senses an out-of-specification condition for conductivity. In addition, if desired, a relay or other electrical activating device or circuit can be provided that opens upon sounding of the alarm to shut down the paint spraying system.

It is preferred that the paint or solvent flowing through conductivity cell 54 be thoroughly mixed to prevent undesirable polarization during conductivity measurements. Accordingly, a mixing baffle 70 (See FIG 3) is provided which is oriented and shaped to provide turbulent mixing of the paint as it flows between electrodes 62 and 64. The baffle 70 is preferably shaped as shown in FIG. 3 to provide sufficient mixing of the paint without adversely affecting overall paint flow.

The following is an exemplary description of operation of the system shown in FIG. 1 for sequentially applying different paints to automobile 10. Master control 30 is programmed to turn on pump 44 and open valve 46 so that solvent from reservoir 20 is pumped through manifold 22 and into spray gun 50. The conductivity of the solvent is much less than the conductivity for the electrostatic paints. The master control 30 by way of controller 56 detects when all contaminants have been flushed from the system and pure solvent is flowing through cell 54. At this point, valve 46 is shut and pump 44 is turned off. Pump 24 and valve 32 are then opened for pumping of paint from reservoir 14 through manifold 22 and into gun 50. The master control 30, by way of controller 56, detects when paint from reservoir 14 reaches the conductivity cell 54. At this point, or shortly thereafter, the master control signals that painting of the automobile 10 is ready to begin. During the spraying of paint from reservoir 14, the controller 56 continually monitors the conductivity of the paint to ensure that it remains within the desired conductivity specification.

When the spraying of paint from reservoir 14 is completed, valve 32 is closed and pump 24 is turned off by master control 30. Then a solvent wash cycle is performed as follows. Pump 44 is then turned on and valve 46 opened to pump solvent from reservoir 20 through the system to flush paint therefrom. Again, the controller 56 monitors conductivity within cell 54 to determine when solvent reaches the gun 50. As soon as the conductivity measurements indicate that solvent has reached the gun 50 and all of the paint has been flushed from the system, the master control closes valve 46 and turns off pump 44. Pump 26 is then started and valve 34 is opened to pump the second paint from reservoir 16 to gun 50. As previously mentioned, it is preferable that the paints in the different reservoirs have measurably different conductivities so that the particular paint being sprayed can be easily identified by reference to controller 56. However, the paints may have the same conductivity if desired.

The conductivity in cell 54 is continually monitored by controller 56 to provide an indication of when paint from reservoir 16 reaches the spray gun 50. As soon as the conductivity in cell 54 indicates that the paint from reservoir 16 has reached the spray gun, the master control then indicates that painting of the second paint onto the automobile 10 or a second automobile is ready to start. After the spray painting of paint from reservoir 16 is completed, the solvent wash cycle is carried out again. After the solvent wash cycle, a paint change-over to reservoir 18 may be accomplished in the same manner as the prior paint change-over from reservoir 14 to reservoir 16. Alternatively, the master control may be programmed to again pump paint from reservoir 14 into the system.

As is apparent from the above description, the system of the present invention provides an accurate and instantaneous measurement of the particular liquid, be it solvent or electrostatic paint, which is present in spray gun 50. By inputting this information from controller 56 into master control 30, the sequential spraying from paint reservoirs 14, 16 and 18 can be accurately controlled so that a minimum amount of paint and/or solvent is wasted. In addition, the continuous monitoring provided by conductivity cell 54 during the spray painting operation allows immediate detection and alarm when the conductivity of the electrostatic paint is not within specified limits. This feature of the present invention is advantageous not only for the application of multiple paints as just described, but also for the application of a single paint. The system of the present invention is used to apply a single paint by providing a single paint reservoir, pump, valve, and solenoid and the solvent wash system as previously described.

While the embodiment of the present invention shown in FIG. 1 incorporates the conductivity cell 54 within the spray gun 50, it is to be understood that this is merely one alternative. The conductivity cell 54 may optionally be placed anywhere within the liquid conduit 23 which leads from the manifold 22 to the spray gun 50, and preferably is placed close to the spray gun.

Having thus described exemplary embodiments of the present invention, it should be noted by those skilled in the art that the within disclosures are exemplary only and that various other alternatives, adaptations and modifications may be made within the scope of the present invention. Accordingly, the present invention is not limited to the specific embodiments as illustrated herein, but is only limited by the following claims.

What is claimed is:

1. A system for metering the delivery of liquids having different conductivities comprising:
   - a first reservoir containing a first liquid having a first conductivity;
   - a second reservoir containing a second liquid having a second conductivity which is measurably different from said first conductivity;
   - a manifold having first and second inlets for receiving said first and second liquids and an outlet;
   - first pumping means for pumping said first liquid from said first reservoir to said manifold, said first pumping means being operable between on and off pumping positions;
   - second pumping means for pumping said second liquid from said second reservoir to said manifold, said second pumping means being operable between on and off pumping positions;
   - a metering device having an inlet for receiving said first or second liquid from said manifold outlet and a nozzle through which said first or second liquid is dispersed;
   - a liquid conduit connected between said manifold outlet and said metering device inlet to provide liquid flow communication therebetween;
   - a conductivity cell located between said liquid conduit and said metering device nozzle, said conductivity cell having non-conducting interior walls and including means for measuring the conductivity of the liquid flowing therethrough; and
   - control means connected to said conductivity cell and to said first and second pumping means for controlling the operation of said first and second pumping means between said on and off positions based on the conductivity measured in said conductivity cell.

2. A metering system according to claim 1 wherein said first and second liquids are selected from the group consisting of electrostatic paint and solvent therefor.

3. A metering system according to claim 2 further including means for introducing pressurized air to said metering device in sufficient amounts to provide spraying of an aerosol mist of said first or second liquid from said nozzle.

4. A metering system according to claim 3 wherein said metering device includes a flow trigger to control flow of the liquid through said metering device, said flow trigger being connected to said control means and being variably operable between an open flow position and a closed flow position.

5. A metering system according to claim 1 wherein said conductivity cell comprises:
   - a chamber defining a liquid flow zone;
   - at least two conductivity measurement plates located at spaced locations on either side of said flow zone; and wherein
   - said means for measuring the conductivity of the liquid measures the conductivity of the liquid passing between said conductivity measurement plate 6. A metering system according to claim 5 wherein said conductivity cell further includes a baffle plate located within said liquid flow zone, said baffle plate being shaped and oriented within said flow zone to provide mixing of said liquid as the liquid passes through said flow zone.

7. A metering system according to claim 2 wherein said first liquid is solvent and said second liquid is electrostatic paint.

8. A metering system according to claim 1 wherein said means for measuring the conductivity of liquids flowing through said conductivity cell comprises means for measuring alternating current conductivity.

9. A metering system according to claim 1 wherein said conductivity cell is located in said metering device.

10. A process for metering the delivery of liquids having different conductivities comprising the steps of:

providing a plurality of reservoirs containing the liquids having measurably different conductivities;

providing a metering device and a conductivity cell that is capable of continuously measuring the conductivity of the liquids passing through said metering device from said reservoirs, wherein said conductivity cell has non-conducting interior walls and includes two measurement plates located at spaced locations within the liquid passing through said conductivity cell, and a mixing plate to promote uniform mixing of said liquid as it passes through said cell;

measuring the conductivity of said liquid as it flows through said conductivity cell; and selectively controlling the flow of said liquids to said metering device based on the measurement of conductivity provided by said conductivity cell.

* * * * *